US005116272A

United States Patent [19]

Blaisdell et al.

[11] Patent Number: 5,116,272

[45] Date of Patent: May 26, 1992

[54] METHOD AND APPARATUS FOR FORMING APERTURES IN FLUORESCENT LAMPS

[75] Inventors: Ronald G. Blaisdell, Saugus; Harold L. Hough, Beverly; Robert Y. Pai, Hamilton, all of Mass.

[73] Assignee: GTE Products Corporation, Danvers, Mass.

[21] Appl. No.: 547,942

[22] Filed: Jul. 3, 1990

[51] Int. Cl.[5] ..... H01J 9/00; H01J 61/35

[52] U.S. Cl. ..... 445/26; 15/93.1; 427/67; 427/277

[58] Field of Search ..... 425/26, 58; 427/67, 427/277, 356; 83/191, 875; 15/93.1, 220 A

[56] References Cited

U.S. PATENT DOCUMENTS

| | | | |
|---|---|---|---|
| 2,362,384 | 11/1984 | Libby | 176/122 |
| 3,012,168 | 12/1961 | Ray et al. | 313/221 |
| 3,067,351 | 12/1962 | Gungle et al. | 313/109 |
| 3,115,309 | 12/1963 | Spencer et al. | 240/41.35 |
| 3,225,241 | 12/1965 | Spencer et al. | 313/109 |
| 3,275,872 | 9/1966 | Chernin et al. | 313/109 |
| 3,715,941 | 2/1973 | Andrews et al. | 83/191 |
| 3,717,781 | 2/1973 | Sadoski et al. | 313/109 |
| 3,839,085 | 10/1974 | Hulvey et al. | 15/220 A |
| 3,987,331 | 10/1976 | Schreurs | 313/486 |

FOREIGN PATENT DOCUMENTS

| | | | |
|---|---|---|---|
| 44641 | 3/1983 | Japan | 427/67 |

*Primary Examiner*—Kenneth J. Ramsey
*Attorney, Agent, or Firm*—Wolf, Greenfield & Sacks

[57] ABSTRACT

An apparatus for making an aperture in a coating on an inside surface of a lamp envelope such as a miniature fluorescent lamp envelope. The apparatus includes a magnetic scraping tool disposed adjacent to the inside surface of the lamp envelope and a magnet disposed adjacent to the outside surface of the lamp envelope so as to influence the scraping tool. The magnet acts on the magnetic scraping tool to maintain a scraping portion of the scraping tool in contact with the inside surface of the lamp envelope. As the magnet is moved along the outside of the lamp envelope, the scraping tool is pulled through the inside of the lamp envelope with sufficient clamping force to scrape a desired width of coating from the inside surface of the lamp envelope. In one embodiment, a guide is provided to guide the scraping tool through the lamp envelope. In a preferred embodiment, the scraping tool and the magnet are coupled to the guide. The guide moves the magnet and the scraping tool along the lamp envelope. A scraping insert on the scraping tool is sized to remove the coating from a predetermined area of the inside surface of the lamp envelope.

15 Claims, 3 Drawing Sheets

METHOD AND APPARATUS FOR FORMING APERTURES IN FLUORESCENT LAMPS

FIELD OF THE INVENTION

The present invention relates generally to the field of lamps. More particularly, the present invention relates to a method and apparatus for making an aperture in a coating on an inside surface of a tubular fluorescent lamp envelope.

BACKGROUND OF THE INVENTION

Tubular light sources, such as fluorescent lamps, typically provide a generally uniform cylindrical radiation pattern. The inside surface of the lamp envelope is coated with a phosphor material. For some applications, such as photocopy machine printing and liquid crystal display backlighting, a higher brightness than is normally delivered by a conventional fluorescent lamp, is required. The light emitted by a fluorescent lamp can be directed in a preferred direction by scraping away the phosphor coating and any reflective coating along a narrow strip extending the length of the lamp envelope to create an aperture.

Examples of aperture fluorescent lamps are disclosed in U.S. Pat. No. 3,225,241 issued Dec. 21, 1965 to Spencer et al, U.S. Pat. No. 3,987,331 issued Oct. 19, 1976 to Schreurs, U.S. Pat. No. 3,012,168 issued Dec. 5, 1961 to Ray et al, U.S. Pat. No. 3,275,872 issued Sep. 27, 1966 to Chernin et al, U.S. Pat. No. 3,115,309 issued Dec. 24, 1963 to Spencer et al, U.S. Pat. No. 3,067,351 issued Dec. 4, 1962 to Gungle et al and U.S. Pat. No. 3,717,781 issued Feb. 20, 1973 to Sadoski et al.

In the case of relatively large diameter fluorescent lamps, the aperture in the coating can be made using a scraper attached to the end of a rigid rod. As the scraper is pushed through the glass tube, radial pressure is applied to the rigid rod to keep the scraper in contact with the inside surface of the glass tube. The steel rod is of sufficient diameter to resist bending as the scraper is pushed through the glass tube.

In the case of relatively small diameter fluorescent lamps, i.e., those having a diameter of less than ½ inch, it is difficult to remove the phosphor coating from the inside surface of the lamp envelope to create an aperture. A miniature fluorescent lamp typically has an inside diameter in the range of about 3.75 mm to 5.75 mm. The overall length typically ranges from 4 to 20 inches. Due to the small inside diameter and the relatively long length, it is generally difficult to use the same scraping method and apparatus that are used for the larger diameter lamps. In particular, due to the vary small diameter required of any rod used to direct a scraper through the small diameter glass tube, it has been difficult to hold the scraper securely against the inside surface of the lamp to create an aperture because the rod tends to bend. Due to the difficulty of maintaining contact between the scraper and the inside lamp surface, multiple passes are required to remove all of the coating from a predetermined aperture. Multiple passes through the lamp increase the likelihood that the aperture will have a nonuniform width. Furthermore, the phosphor material is often abrasive in nature, and lamp envelopes have varying diameters due to manufacturing tolerances. Therefore, although a soft scraper is required to conform to diameter variations, the scraper must be sufficiently hard to resist the abrasive characteristics of the phosphor coating. A scraping tool for removing a coating from the inside surface of a lamp is disclosed in U.S. Pat. No. 2,362,384 issued Nov. 7, 1944 to Libby.

It is an object of the present invention to provide improved methods and apparatus for removing a predetermined area of phosphor coating and any reflective coating from the inside surface of a lamp envelope to provide an optical aperture.

Another object of the invention is to provide methods and apparatus for manufacturing aperture lamps wherein coatings are uniformly removed from the inside surface of the lamp envelope.

Still another object of the present invention is to provide methods and apparatus for making aperture lamps wherein apertures are manufactured faster and with more uniform results than in the prior art.

A further object of the invention is to provide methods and apparatus for making aperture lamps wherein removal of the coating from the inside surface of the lamp envelope is accomplished using fewer passes of the scraping tool through the lamp envelope.

SUMMARY OF THE INVENTION

The foregoing and other objects, features, and advantages of the present invention are achieved in a method and apparatus for making an aperture in a coating on an inside surface of a lamp envelope. The apparatus includes a magnetic scraping tool disposed adjacent to the inside surface of the lamp envelope and a magnet disposed adjacent to the outside surface of the lamp envelope so as to influence the scraping tool. The magnet acts on the magnetic scraping tool to maintain a scraping portion of the scraping tool in contact with the inside surface of the lamp envelope. The magnet applies a clamping pressure between the coated glass surface and the scraping tool. As the magnet is moved along the outside of the lamp envelope, the magnet applies a pulling force that draws the scraping tool through the inside of the lamp envelope with sufficient force to scrape a desired width of coating from the inside surface of the lamp envelope.

In one embodiment of the invention, a guide is provided to guide the scraping tool through the lamp. In a preferred embodiment of the invention, the scraping tool and the magnet are both coupled to the guide. The guide moves the scraping tool through the lamp envelope, and the magnet maintains the scraping portion of the scraping tool in contact with the inside surface of the lamp envelope. The apparatus can be operated manually or by a drive mechanism to move the scraping tool through the lamp envelope.

A scraping insert on the scraping tool is sized to remove the coating from a predetermined area of the inside surface of the lamp envelope. The scraping insert includes a blade that removes the coating. The scraping insert is preferably fabricated of a resilient polymer material which accommodates diameter variations in the glass tube and at the same time resists the abrasiveness of the phosphor coating.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

For purposes of illustration only, and not to limit generality, the present invention is described with reference to its use in making apertures in miniature fluorescent lamps. However, one skilled in the art will recognize that the present invention may be used to create apertures in other types of lamps, including larger diameter lamps, and in lamps having shapes other than the tubular shape of a fuorescent lamp.

Figure 1:
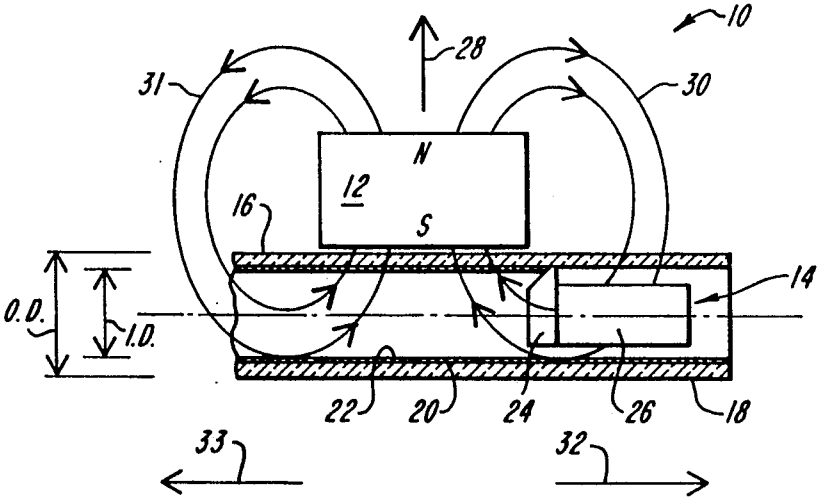
FIG. 1 is a schematic, partial cross section of a miniature fluorescent lamp generally illustrating the technique of the present invention for scraping the phosphor coating from a portion of the inside surface of the lamp envelope.
Figure 2:
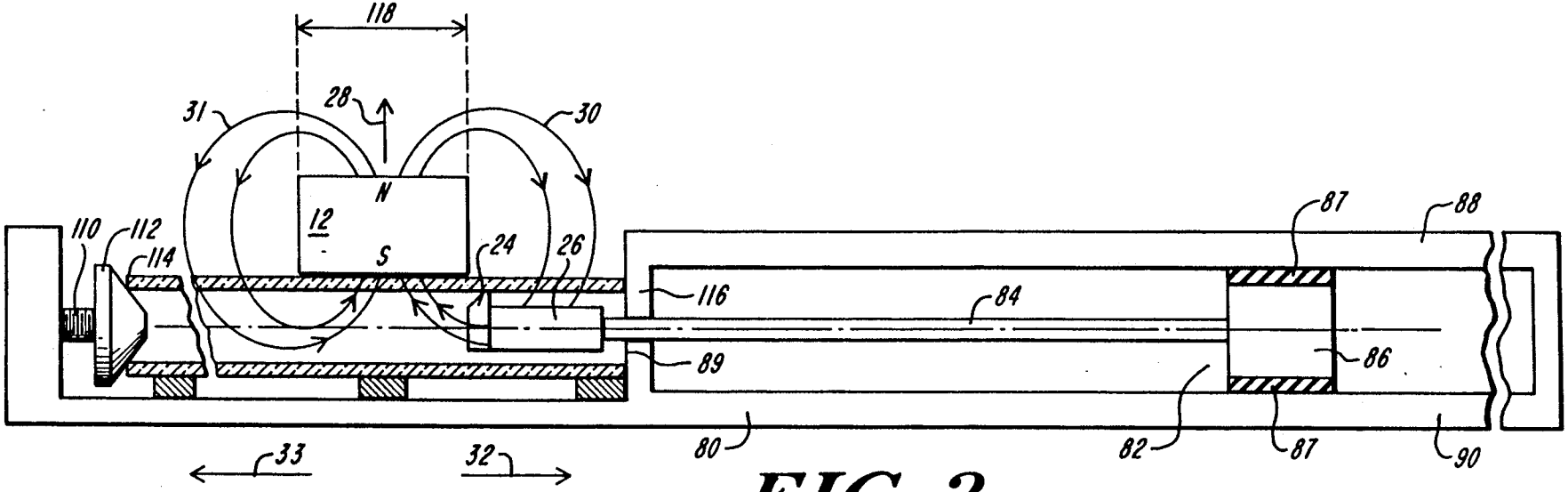
FIG. 2 is a cross section of another embodiment of the invention.
Figure 3:
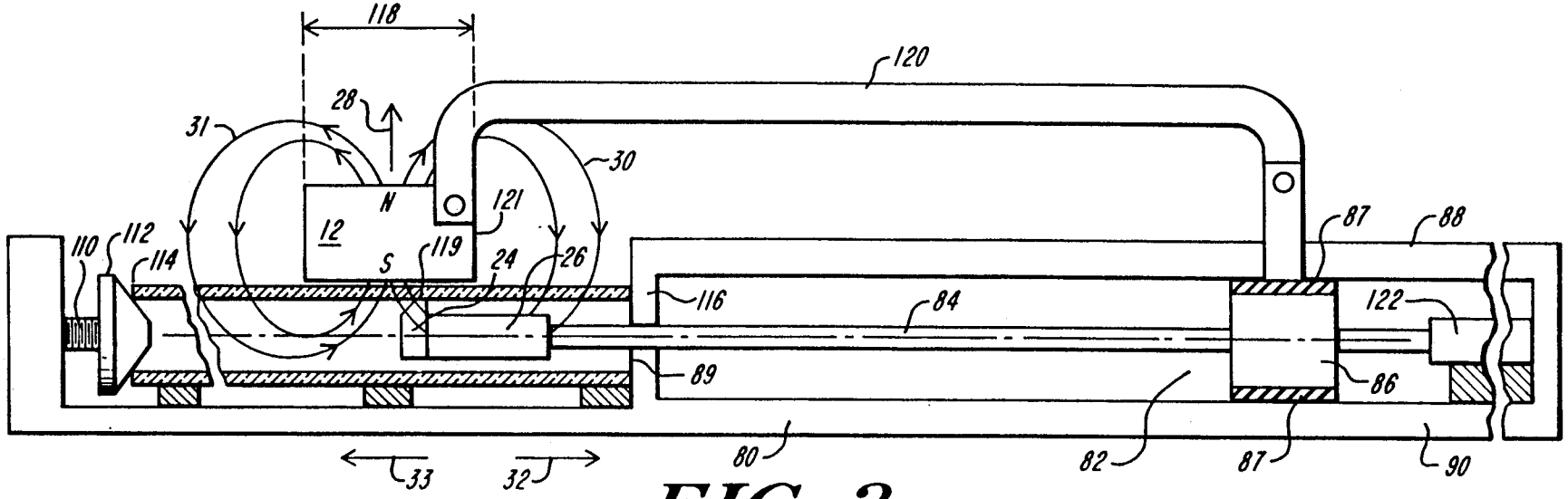
FIG. 3 is a cross section of a preferred embodiment of the invention.

Reference is now made to FIGS. 1-3 which illustrate different embodiments of the invention. In the drawings, like elements have the same reference numerals. Referring to FIG. 1, there is shown, in general schematic illustration, a method and apparatus for forming an aperture in a coating on the inside surface of a fluorescent lamp envelope. The apparatus 10 generally includes a magnet 12 and a scraping tool 14. Magnet 12 may include a single magnet or a plurality of magnets. Magnet 12 is disposed adjacent to an outer surface 16 of a fluorescent lamp envelope 18.

Fluorescent lamp envelope 18 is of a miniature type and in the present example has an inside diameter ID in the range of about 3.75 mm to 5.25 mm. Miniature fluorescent lamp envelope 18 is generally tubular in shape and typically has a length of 4 to 20 inches. An inside surface 20 of lamp envelope 18 is uniformly coated with a coating 22, which coating may include, but is not limited to a phosphor layer and a reflective layer.

Scraping tool 14 is inserted into fluorescent lamp envelope 18 after application of coating 22 but prior to installation of filaments. Scraping tool 14 includes a scraping insert 24 and a magnetic insert holder 26, which is attached to scraping insert 24. Magnetic insert holder 26 is a magnetic material, such as cold rolled steel or the like.

Scraping insert 24 must be somewhat resilient because the inside diameter ID of fluorescent lamp envelope 18 varies from lamp envelope to lamp envelope and over the length of a lamp envelope due to manufacturing tolerances. Therefore scraping insert 24 must be flexible enough to remain in contact with inside surface 20 despite variations in the inside diameter ID of fluorescent lamp envelope 18. However, the coating 22 is often abrasive and can rapidly wear scraping inserts which are soft. Therefore, scraping insert 24 must be sufficiently hard to resist rapid wear by the coating 22. Scraping insert 24 is typically molded of a resilient material such as a polymer or the like. A material which has proven advantageous for use as the scraping insert 24 is urethane rubber having a hardness in the durometer range of about 90 A to 50 D. A preferred urethane is available under the tradename Adiprene. Urethane rubber possesses the necessary combination of flexibility and resistance to abrasion that make it suitable as a scraping insert material.

Magnet 12 is subjected to provide a very strong magnetic field for a given size. Magnets containing rare earth elements have been found to work particularly well. A one inch cube magnet, available under the tradename HICOREX 90 and manufactured by Permag, is a rare earth cobalt magnet which generates a magnetic force of about 28 pounds and has proven useful in the present invention. The magnet 12 can also be an electromagnet, which provides the advantage that the magnetic field can be controlled electrically.

During operation, scraping tool 14 is inserted into an open end of fluorescent lamp envelope 18, which is preferably held in an appropriate jig, or may simply be held in place by the apparatus user. Thereafter, magnet 12 is placed adjacent to the outside surface 16 of lamp envelope 18. Magnet 12 exerts a radially outward attractive force along the direction of arrow 28. Magnetic flux, as indicated by magnetic flux lines 30, pass through magnetic insert holder 26 from magnetic pole N to magnetic pole S. Magnet 12 exerts a force that is sufficient to slightly deform scraping insert 24 and to clamp scraping tool 14 against the inside surface 20 of lamp envelope 18. Thereafter, as the magnet 12 is moved along the outside surface 16 of lamp envelope 18 in an axial direction defined by arrows 32 or 33, scraping tool 14 is pulled along the inside surface 20 of fluorescent lamp envelope 18 and removes the coating 22 from a desired region of the inside surface to thereby form an aperture in the coating. In the embodiment of FIG. 1. magnet 12 exerts on scraping tool 14 both a clamping force in the direction of arrow 28, and a pulling force in the direction of travel defined by arrows 32 or 33. The required number of passes through the lamp envelope 18 to cleanly remove the coating from the desired aperture region is a function of the coating thickness, the condition of the coating, variations in the inside diameter ID of lamp 18 and the condition of scraping insert 24.

Figure 5A:
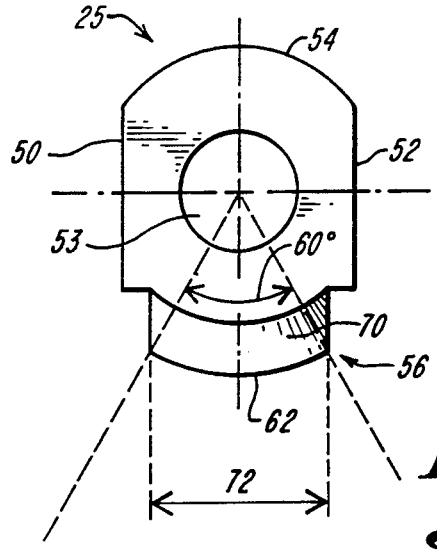
FIGS. 5A and 5B illustrate, in front and side views respectively, another embodiment of the scraper insert for making a different predetermined aperture.
Figure 5B:
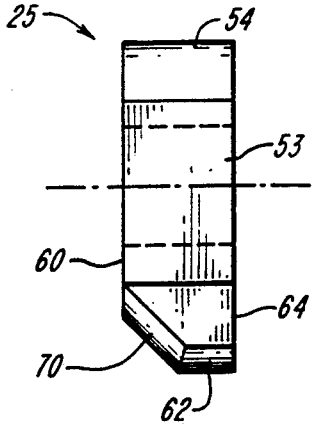
Figure 6:
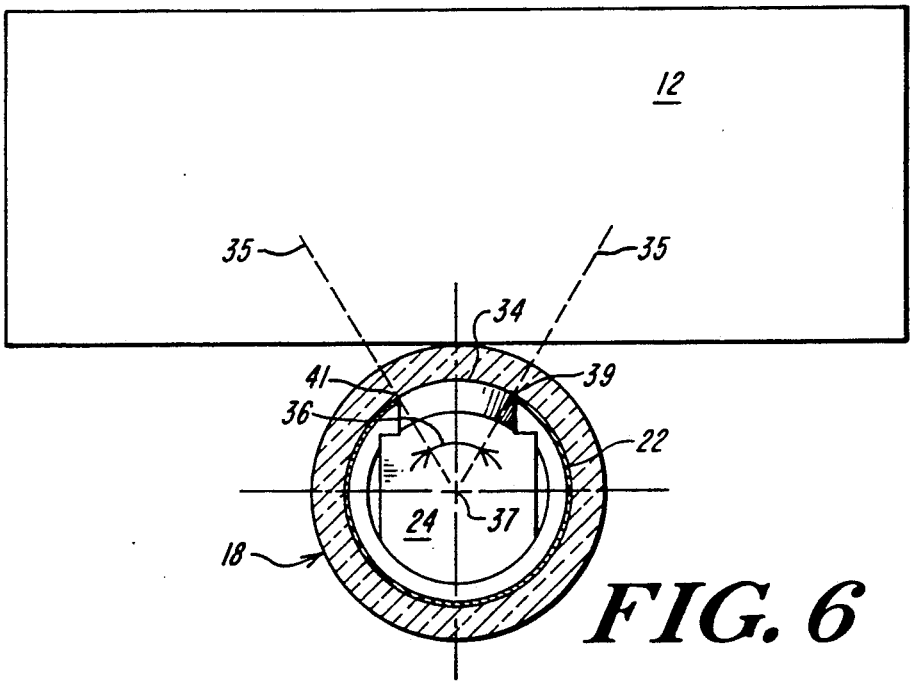
FIG. 6 is a cross section of a lamp envelope illustrating the placement of the scraping insert.

Reference is now made to FIG. 6, which illustrates the relationship between scraping insert 24, lamp envelope 18, and magnet 12. Reference is also made to FIGS. 4A, 4B and 5A, 5B which illustrate details of scraping inserts 24 and 25, respectively. Scraping insert 24 comprises a piece of molded urethane rubber as described above. Insert 24 includes two parallel walls, 50 and 52, and a generally curved wall 54 connecting walls 50 and 52. A hole 52 is provided in insert 54 for connection to insert holder 26, as will be explained in greater detail hereinafter. Curved wall 54 is configured to approximate the curvature of the inside surface 2 of lamp envelope 18. Opposite curved wall 54 is provided with a scraper blade 56. Scraper blade 56 includes a sloped portion 58 which connects a front wall 60 to a bottom wall 62 at an angle of approximately 45°. Bottom wall 62 in turn connects sloped portion 58 to a back wall 64 in a direction generally parallel to curved wall 54. Bottom wall 62 has a curvature which matches the curvature of the inside surface 20 of lamp envelope 18.

The width 66 of blade 56 is selected to provide an aperture having a 30° aperture angle in lamp envelope 18. As shown in FIG. 6, an aperture 34 is created when blade 56 removes coating 22 from the inside surface 20 of lamp envelope 18. The aperture angle 36 of aperture 34 is defined by lines 35 which extend from a center 37 of lamp envelope 18 through edges 39 and 41 of aperture 34.

Figure 4B:
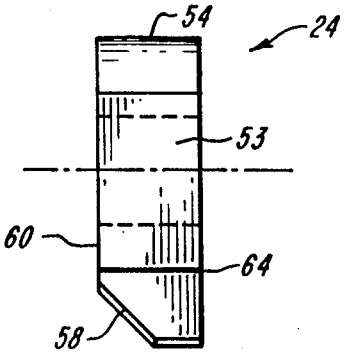
FIGS. 4A and 4B illustrate, in front and side views respectively, one embodiment of the scraper insert for making a predetermined aperture.
Figure 4A:
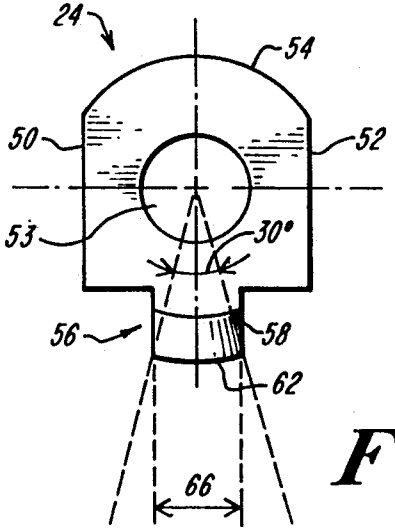

Referring to FIGS. 5A and 5B, there is shown a scraping insert 25 having the same overall dimensions and construction as the scraping insert 24 illustrated in FIGS. 4A and 4B, except that the scraping insert 25 has a blade 70 that is wider than the blade 58 of the scraping insert 24. The width 72 of blade 70 is twice as wide as blade portion 56. Thus, the aperture angle created by scraper blade 70 is 60°. One skilled in the art will appreciate that the size and the configuration of the scraper blade depends upon the desired aperture and that scraping insert 24 can be molded or machined in order to achieve the desired aperture size and configuration.

Although the embodiment of the invention illustrated in FIG. 1 maintains scraping tool 14 clamped against the inside surface 20 of lamp envelope 18, scraping tool 14 may occasionally be subject to chattering against the inside surface 20 of lamp envelope 18 as magnet 12 is moved in the directions indicated by arrows 32 and 33.

Reference is now made to FIG. 2, which illustrates another embodiment of the invention. In the embodiment of FIG. 2, a fixture 80 is provided which holds lamp envelope 18 in a secure fashion. The fixture 80 includes a guide 82 for controlling the motion of scraping tool 14. Guide 82 includes a control rod 84, a carriage 86, and guide members 88 and 90. Control rod 84 is constructed of any suitable nonmagnetic material, such as a 300 series stainless steel welding rod. Control rod 84 has a generally circular cross section and is equal to or longer than lamp envelope 18. Control rod 84 is attached to carriage 86. Carriage 86 is in turn movably disposed between guide members 88 and 90 using a bearing means 87.

Figure 7A:
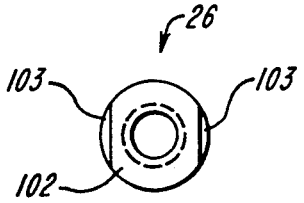
FIGS. 7A and 7B illustrate, in end and side views respectively, the magnetic insert holder of the cleaning tool.
Figure 7B:
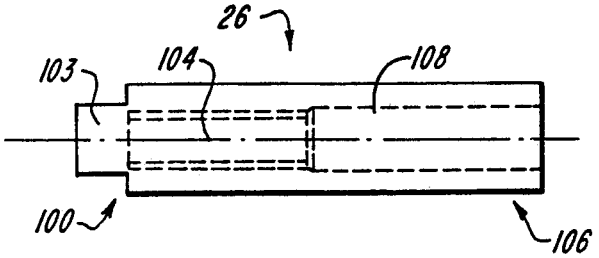

Control rod 84 is also attached at an end 89 to magnetic insert holder 26. Referring to FIGS. 7A and 7B, there is shown, in end and side views respectively, one embodiment of the insert holder 26 which may be used in the apparatus of FIG. 2. Insert holder 26 has a generally circular cross section and is made of a magnetic material such as cold-rolled steel. One end 100 of insert holder 26 is milled to provide a recessed portion 102 between projections 103. A first threaded bore 104 is provided in end 100 of insert 26. Scraping insert 24 is pressed into recessed portion 102 and is secured in place with an appropriate fastener. The insert holder 26 is typically less than one inch in length.

On the other end 106 of insert holder 26, there is provided a bore 108. Bore 108 has a diameter suitable for press fitting on the end 89 of control rod 84. Insert holder 26 may be attached to control rod 84 using an adhesive. Control rod 84 may also bs a threaded rod, and a mating threaded bore is then provided in insert holder 26.

During operation, lamp envelope 18 is placed in fixture 80 and held in place by tightening securing screw 110 which in turn moves plug 112 into contact with the end 114 of lamp envelope 18. Lamp envelope 18 is thus held securely between plug 112 and end wall 116. End wall 116 has an appropriate opening to allow scraping tool 14 and control rod 84 to pass into lamp envelope 18. As magnet 12 is moved in the directions indicated by arrows 32 and 33, scraping tool 14, control rod 84, and carriage 86 all move as one unit. The apparatus of FIG. 2 provides the advantage that scraping tool 14 is guided so as to create an aperture of uniform and predictable width in the desired location in the lamp envelope 18. The guide arrangement provides rotation control and linear alignment of the scraping tool 14. However, the embodiment of FIG. 2 exhibits some chattering of the scraping tool 14 as described above in connection with FIG. 1.

The embodiment of the invention illustrated in FIG. 2 provides an apparatus that removes a predetermined area of phosphor coating and/or reflective coating from the inside of lamp envelope 18 to provide a desired optical aperture in a uniform and controlled manner. However, the apparatus of FIG. 2 may require excessive magnet movement in order to move scraping tool 14 within lamp envelope 18. Magnet 12 provides magnetic flux along flux lines 30 and 31 from magnetic pole N to magnetic pole S. When magnet 12 is moved in the direction of arrow 33, magnetic flux lines 30 exert a magnetic pulling force on insert holder 26 to move insert holder along the direction of arrow 33. However, when magnet 12 is subsequently moved in a direction indicated by arrow 32, magnet 12 moves without moving insert holder 26 until insert holder 26 comes within the influence of magnetic flux lines 31. Thus, magnet 12 is moved in a direction along arrow 32 or 33 a distance approximately equal to a width 118 of magnet 12 before a corresponding movement of scraping tool 14 occurs.

To eliminate this extraneous magnet motion and to substantially reduce chatter, a preferred embodiment of the invention is provided as illustrated in FIG. 3. In FIG. 3, a coupling member 120 mechanically couples magnet 12 to carriage 86. Thus, insert holder 26 is maintained within the influence of magnetic flux lines 30 despite movement of magnet 12 in the direction of arrows 33 or 32. In the embodiment of FIG. 3, magnet 12 is used only to provide a clamping force in the direction of arrow 28 to hold scraping tool 14 securely against the inside surface 20 of lamp envelope 18. The connection between magnet 12 and carriage 86 can be a pivotal connection to accommodate variations in the thickness of the lamp envelope. The apparatus of FIG. 3 also maintains the proper relationship between magnet 12 and scraping tool 14 at all times to provide uniform aperture widths. It has been found desirable to position the blade of scraping insert 24 at a location 119 that is approximately one third of width 118 from end 121 of magnet 12.

During operation, carriage 86 may be moved manually, or mechanically using an air cylinder 122 or motor, etc. The apparatus of FIG. 3 thus provides a smooth and controlled scraping action, thereby allowing aperture lamp envelopes to be manufactured more efficiently, more uniformly, and with higher quality than was possible in the prior art.

Having thus described one particular embodiment of the invention, various alterations, modifications, and improvements will readily occur to those skilled in the art. For example, one skilled in the art will appreciate that, although the invention has been described with regard to its use in making an aperture in miniature fluorescent lamps, it is not so limited. The present invention can be readily adapted to make apertures in larger diameter lamps, as well as apertures in lamps having shapes other than a tubular configuration. However, the present invention is particularly useful in small diameter lamp envelopes wherein it has proven difficult to maintain a scraping tool in contact with the inside surface of the lamp envelope. Such alterations, modifications, and improvements as are made obvious by this disclosure are intended to be part of this disclosure though not expressly stated herein, and are intended to be within the spirit and scope of the invention. Accordingly, the foregoing description is by way of example only and is not intended as limiting. The invention is limited only as defined in the following claims and equivalents thereto.

What is claimed is:

1. Apparatus for making an aperture in a coating on an inside surface of a lamp envelope, comprising:

scraping tool means disposed adjacent to the inside surface of the lamp envelope, said scraping tool means including a magnetic material;

magnet means disposed adjacent to an outside surface of the lamp envelope to influence the scraping tool means, said magnet means maintaining a scraping portion of the scraping tool means in contact with the inside surface of the lamp envelope;

guide means attached to the scraping tool means for guiding the scraping tool means along a direction substantially parallel to the inside surface of the lamp envelope; and means for coupling the magnet means to the guide means, comprising a coupling member which maintains said magnet means and said scraping tool means in fixed relative positions during scraping.

2. The apparatus of claim 1 further comprising means for moving the magnet means and the scraping tool means in the direction defined by the guide means.

3. The apparatus of claim 1 wherein the scraping tool means comprises means for removing the coating from a predetermined area of the inside surface of the lamp envelope.

4. The apparatus of claim 1 wherein the guide means comprises a nonmagnetic control rod coaxially disposed with the scraping tool means.

5. Apparatus as defined in claim 1 wherein said scraping tool means is dimensioned for use in a tubular lamp envelope having an inside diameter in a range of about 3.75 mm to 5.25 mm.

6. Apparatus for making an aperture in a coating on an inside surface of a lamp envelope, comprising:

scraping tool means disposed adjacent to the inside surface of the lamp envelope, said scraping tool means including a magnetic material; and magnet means disposed adjacent to an outside surface of the lamp envelope to influence the scraping tool means, said magnet means maintaining a scraping portion of the scraping tool means in contact with the inside surface of the lamp envelope, said scraping tool means comprising means for removing the coating from a predetermined area of the inside surface of the lamp envelope and including a scraping insert means comprising a resilient material.

7. The apparatus of claim 6 wherein the scraping insert means comprises a polymer material.

8. The apparatus of claim 7 wherein the resilient polymer material comprises urethane rubber having a durometer in a range of about 90A to 50 D.

9. Apparatus as defined in claim 6 wherein said magnet means deforms said resilient insert, thereby ensuring contact between said resilient insert and said lamp envelope.

10. The apparatus of claim 6 wherein the scraping tool means further comprises a magnetic insert holder coupled to the scraping insert means.

11. The apparatus of claim 1 wherein the magnet means maintains the scraping tool means in intimate contact with the inside surface of the lamp envelope.

12. The apparatus of claim 1 wherein the magnet means includes at least one rare earth magnet.

13. The apparatus of claim 1 wherein the lamp envelope is a tubular envelope and the coating on the inside surface of the tubular envelope includes a phosphor layer and a reflective layer.

14. A method for making an aperture in a coating on an inside surface of a lamp envelope, comprising the steps of:

providing a magnetic scraping tool means disposed adjacent to an inside surface of the lamp envelope;

providing a magnet means disposed adjacent to an outside surface of the lamp envelope to influence the scraping tool means, said magnet means being disposed to maintain a scraping portion of the scraping tool means in contact with the inside surface of the lamp envelope;

moving the magnet means along the outside surface of the lamp envelope so that the scraping tool means moves through the lamp envelope and removes the coating from a predetermined area of the inside surface of the lamp envelope;

providing a guide means attached to the scraping tool means for directing the scraping tool in a direction substantially parallel to the inside surface of the lamp envelope;

moving the scraping tool means in a direction defined by the guide means;

providing a carriage means which moves in a direction defined by the guide means;

coupling the magnet means and the carriage means together; and moving the carriage means to move the magnet means and the scraping tool means substantially simultaneously in a direction substantially parallel to the inside surface of the lamp envelope.

15. Apparatus for making an aperture in a coating on an inside surface of a tubular lamp envelope, comprising:

a scraping tool positioned adjacent to the inside surface of the lamp envelope, said scraping tool comprising a resilient scraping insert and a magnetic insert holder;

magnet means positioned adjacent to an outside surface of the lamp envelope, said magnet means maintaining the scraping portion of the scraping tool in contact with the inside surface of the lamp envelope; and guide means for maintaining said scraping tool and said magnet means in fixed relative positions as said scraping tool is moved through said lamp envelope.

* * * * *